US008913936B2

(12) United States Patent
Takada et al.

(10) Patent No.: US 8,913,936 B2
(45) Date of Patent: Dec. 16, 2014

(54) IMAGE HEATING APPARATUS AND IMAGE FORMING APPARATUS

(71) Applicant: Canon Kabushiki Kaisha, Tokyo (JP)

(72) Inventors: Shigeaki Takada, Abiko (JP); Osamu Sugino, Abiko (JP); Teppei Nagata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/790,859

(22) Filed: Mar. 8, 2013

(65) Prior Publication Data

US 2013/0272759 A1 Oct. 17, 2013

(30) Foreign Application Priority Data

Apr. 13, 2012 (JP) ..... 2012-091973

(51) Int. Cl.
*G03G 15/20* (2006.01)

(52) U.S. Cl.
CPC ..... *G03G 15/2053* (2013.01); *G03G 15/2017* (2013.01); *G03G 2215/2032* (2013.01)
USPC ..... 399/329; 399/122; 399/328; 399/330; 219/216

(58) Field of Classification Search
USPC ..... 399/67, 122, 320, 328, 329, 330, 331; 219/216
See application file for complete search history.

(56) References Cited

U.S. PATENT DOCUMENTS

| | | | | |
|---|---|---|---|---|
| 5,149,941 | A | 9/1992 | Hirabayashi et al. | |
| 5,300,997 | A | 4/1994 | Hirabayashi et al. | |
| 5,343,280 | A | 8/1994 | Hirabayashi et al. | |
| 5,767,484 | A | 6/1998 | Hirabayashi et al. | |
| 7,200,354 | B2 | 4/2007 | Nakamoto et al. | |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,817,950 | B2 * | 10/2010 | Burton et al. | 399/323 |
| 7,844,208 | B2 | 11/2010 | Hayashi et al. | |
| 8,301,067 | B2 | 10/2012 | Takada | |
| 2010/0247182 | A1 * | 9/2010 | Miyata et al. | 399/329 |
| 2011/0211879 | A1 * | 9/2011 | Li et al. | 399/329 |
| 2012/0003346 | A1 | 1/2012 | Chigono et al. | |
| 2012/0155940 | A1 | 6/2012 | Hagiwara et al. | |
| 2012/0251153 | A1 | 10/2012 | Takada | |
| 2013/0051831 | A1 | 2/2013 | Shinagawa et al. | |
| 2013/0058672 | A1 | 3/2013 | Takada et al. | |

(Continued)

FOREIGN PATENT DOCUMENTS

| | | | |
|---|---|---|---|
| JP | 63-313182 | A | 12/1988 |
| JP | 2004-037555 | A | 2/2004 |

*Primary Examiner* — Francis Gray

(74) *Attorney, Agent, or Firm* — Fitzpatrick, Cella, Harper & Scinto

(57) ABSTRACT

An inner heating member is disposed in contact with an inner circumferential surface of a heating belt and an outer heating member is disposed in contact with an outer circumferential surface of the heating belt to heat the heating belt. A restricting member configured to restrict an orbit of the heating belt is disposed between the inner and outer heating members. Then, at least either one of an area of contact between the inner circumferential surface of the heating belt and the inner heating member and an area of contact between the outer circumferential surface of the heating belt and the outer heating member is changed to quickly change a quantity of heat applied to the outer circumferential surface or inner circumferential surface of the heating belt.

13 Claims, 10 Drawing Sheets

(56) References Cited

U.S. PATENT DOCUMENTS

| | | | | |
|---|---|---|---|---|
| 2013/0108335 | A1 | 5/2013 | Nagata | |
| 2013/0129364 | A1 | 5/2013 | Kitagawa et al. | |
| 2013/0142532 | A1 | 6/2013 | Kitagawa et al. | |
| 2013/0164015 | A1 | 6/2013 | Kawai et al. | |
| 2013/0206745 | A1 | 8/2013 | Tanaka et al. | |
| 2013/0236745 | A1* | 9/2013 | Norton | 429/7 |
| 2013/0272757 | A1* | 10/2013 | Amano et al. | 399/329 |
| 2013/0287458 | A1* | 10/2013 | Nagata | 399/323 |

* cited by examiner

IMAGE HEATING APPARATUS AND IMAGE FORMING APPARATUS

BACKGROUND OF THE INVENTION

1. Field of the Invention

The present invention relates to an image heating apparatus configured to heat an image formed on a recording medium by a heating belt, and to an image forming apparatus using the same.

2. Description of the Related Art

Regarding an image forming apparatus, it is generally known to transfer a toner image formed by an image forming portion that carries out an appropriate image forming process such as an electrophotographic process, an electrostatic recording process, a magnetic recording process and others to a recording medium by an intermediate transfer method or a direct transfer method, and to fix the non-fixed toner image transferred to the recording medium onto the recording medium by heating and pressing by a fixing apparatus, i.e., an image heating apparatus. It is also known to control the glossiness of an image by heating the image fixed to the recording medium again by the fixing apparatus.

Japanese Patent Application Laid-open No. S63-313182 for example discloses a belt-type heating apparatus, as such fixing apparatus, that allows a width of a nip portion through which a recording medium is passed to heat an image to be widened and a warm-up time to be shorted. That is, conventionally, there has been known a configuration of fixing an image on a recording medium by forming a nip portion by a heated belt as a fixing member and a pressure roller and by passing the recording medium on which a toner image has been formed through this nip portion.

However, because the recording medium draws heat from the fixing member in passing through the nip portion, Japanese Patent Application Laid-open No. 2004-37555 discloses a configuration of heating the fixing member not only from an inner side but also from an outer side thereof. This configuration enables shortening of the time required to attain a required surface temperature of the fixing member because the fixing member is heated also from the outer side.

By the way, an image forming apparatus capable of executing a series of image forming jobs while properly identifying and using different types of recording media is put into practical use these days. This type of image forming apparatus makes it possible to use thick sheets as front and back covers and to use thin sheets as a body portion interposed between those covers. Such image forming apparatus also makes it possible to scan a plurality of groups of originals by a scanner at once, and then to copy a first scanned group by thin sheets and to copy a second scanned group by thick sheets for example. In the same manner, the image forming apparatus can readily realize such technique of printing while changing over types of sheets per each of plurality of image datum supplied from a client apparatus such as a personal computer.

It is preferably to change the quantity of heat applied by the fixing apparatus in accordance with the types of recording media in fixing images when properly identifying and using such different types of recording media in forming images. For instance, it is preferably to increase the quantity of heat to be applied in fixing an image on a recording medium, such as a thick sheet whose basis weight is large and to decrease the quantity of heat to be applied in fixing an image on a recording medium, such as a thin sheet, whose basis weight is small. Therefore, it is preferably to change over preset temperatures of heating members provided inside or outside of the fixing member for heating the fixing member in accordance to the types of recording media. However, it takes time to increase/decrease the temperature of the heating member to a desirable temperature just by changing over the preset temperatures, thus, decreasing the productivity of the apparatus.

SUMMARY OF THE INVENTION

The present invention provides an image heating apparatus that maintains productivity even in forming images while properly using different types of recording media. According to a first aspect of the present invention, an image heating apparatus includes an endless heating belt configured to heat an image formed on a recording medium, an inner heating member that is disposed at an inner side of the endless heating belt and is in contact with an inner circumferential surface of the heating belt to heat the heating belt, an outer heating member that is disposed at an outer side of the endless heating belt and is in contact with an outer circumferential surface of the heating belt to heat the heating belt, a restricting member disposed between the inner and outer heating members to restrict an orbit of the heating belt, and a moving mechanism configured to move either one of the inner heating member, the outer heating member, and the restricting member to change at least either one of an area of contact between the heating belt and the inner heating member and an area of contact between the heating belt and the outer heating member.

According to a second aspect of the present invention, an image heating apparatus includes an endless heating belt configured to heat an image formed on a recording medium, an inner heating member that is disposed at an inner side of the endless heating belt and is in contact with an inner circumferential surface of the heating belt to heat the heating belt, an outer heating member that is disposed at an outer side of the endless heating belt and is in contact with an outer circumferential surface of the heating belt to heat the heating belt and a changing means for changing at least either one of an area of contact between the heating belt and the inner heating member and an area of contact between the heating belt and the outer heating member.

Further features of the present invention will become apparent from the following description of exemplary embodiments with reference to the attached drawings.

DESCRIPTION OF THE EMBODIMENTS

Preferred embodiments of the invention will be described below in detail with referent to the drawings.

First Embodiment

Image Forming Apparatus

Figure 1:
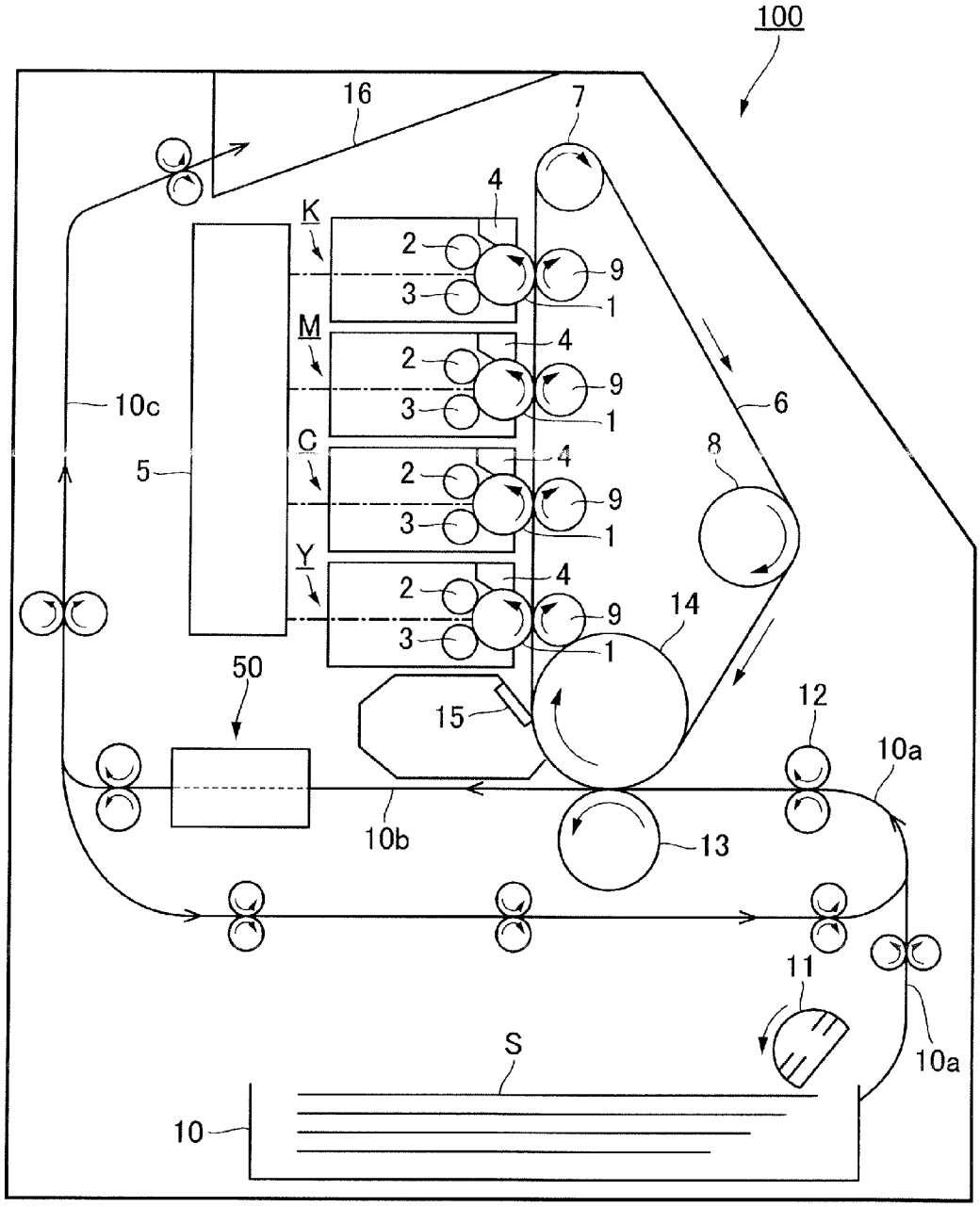
FIG. 1 is a schematic structural view showing one exemplary image forming apparatus to which the invention is applicable.

A schematic structure of one exemplary image forming apparatus to which the invention is applicable will be described first with reference to FIG. 1. As shown in FIG. 1, the image forming apparatus 100 is a tandem-type full-color laser printer in which image forming portions Y, C, M and K that form yellow, cyan, magenta and black images, respectively, are disposed along an intermediate transfer belt 6.

The image forming portions Y, C, M and K are disposed such that they transfer toner images to the intermediate transfer belt 6 sequentially from a lower side to an upper side of FIG. 1. Each of the image forming portions Y, C, M and K includes a photoconductive dram 1 that forms the toner image by using an electro-photographic process. Disposed around each photoconductive dram 1 along a rotational direction thereof are a charging device 2, a developing device 3, a primary transfer roller 9, and a cleaning device 4. An exposure device 5 is disposed such that it exposes the photoconductive drums 1 of the image forming portions Y, C, M and K commonly by using a laser scanning exposure optical system.

Based on image data, the exposure device 5 scans and exposes the photoconductive dram 1 charged uniformly by the charging device 2 in each of the image forming portions Y, C, M and K to form an electrostatic image corresponding to the scanned exposure image data on a surface of the photoconductive dram 1.

The developing device 3 develops the electrostatic image formed on the surface of the photoconductive dram 1 as a toner image. Yellow toner is filled in the developing device 3 of the image forming portion Y, cyan toner is filled in the developing device 3 of the image forming portion C, magenta toner is filled in the developing device 3 of the image forming portion M, and black toner is filled in the developing device 3 of the image forming portion K, respectively. Due to that, a yellow toner image is formed on the photoconductive dram 1 of the image forming portion Y, a cyan toner image is formed on the photoconductive dram 1 of the image forming portion C, a magenta toner image is formed on the photoconductive dram 1 of the image forming portion M, and a black toner image is formed on the photoconductive dram 1 of the image forming portion K, respectively.

The monochromatic toner images of the respective colors described above developed respectively on the photoconductive drums 1 of the image forming portions Y, C, M and K are transferred primarily on the intermediate transfer belt 6 that rotates at constant speed in synchronism with the rotation of the photoconductive drams 1 such that those toner images are sequentially superimposed under a predetermined condition in which their positions are aligned. As a result, a non-fixed full-color toner image is composed and formed on the intermediate transfer belt 6.

The image forming apparatus uses the endless intermediate transfer belt 6 that is stretched around a driving roller 7, a secondary transfer counterface roller 14 and a tension roller 8, and is rotationally driven by the driving roller 7.

The primary transfer roller 9 of each of the image forming portions Y, C, M and K presses the intermediate transfer belt 6 against each of the photoconductive drams 1 to create a toner image primary transfer portion between the photoconductive dram 1 and the intermediate transfer belt 6.

A bias power source, not shown, applies a primary transfer bias voltage whose polarity is reversed from that of the toner image to the primary transfer roller 9. As a result, the toner image of each color is primarily transferred from each photoconductive drum 1 of the image forming portions Y, C, M and K to the intermediate transfer belt 6.

After primarily transferring the toner image from the photoconductive dram 1 to the intermediate transfer belt 6 in each of the image forming portions Y, C, M and K, the cleaning device 4 removes transfer residual toner remaining on the photoconductive dram 1.

The toner images of the respective colors are sequentially superimposed and primarily transferred on the intermediate transfer belt 6 by carrying out such processes in the yellow, cyan, magenta and black image forming portions Y, C, M and K in synchronism with the rotation of the intermediate transfer belt 6. It is noted that the above-mentioned process is carried out only in a subject color image forming portion, e.g., the black image forming portion K, in forming an image of one-color (monochromatic mode).

Meanwhile, a recording medium S stacked in a recording medium cassette 10 is separated and fed one by one by a feed roller 11, passes through a conveying path 10*a*, and stops in a condition in which an edge thereof comes in contact with a registration roller 12. The recording medium S is conveyed in alignment with a center thereof. By being activated with predetermined control timing, the registration roller 12 feeds the recording medium S to a secondary transfer portion, i.e., a nip portion, between the intermediate transfer belt 6 and a secondary transfer roller 13.

The secondary transfer roller 13 is in contact with the intermediate transfer belt 6 supported from the inside by a secondary transfer counterface roller 14 connected to a ground potential to form the secondary transfer portion that transfers the toner images onto the recording medium S. The toner images, superimposed by being primarily transferred on the intermediate transfer belt 6, are secondarily transferred on the recording medium S in a batch, as a bias voltage whose polarity is reversed from that of the toner is applied to the secondary transfer roller 13 from a bias power source not shown. A part including the image forming portions Y, C, M and K described above, the intermediate transfer belt 6 and the secondary transfer roller 13 corresponds to an image forming unit, described in the claims, that forms an image on a recording medium.

A belt cleaning device 15 removes secondary transfer residual toner remaining on the intermediate transfer belt 6 that has passed through the secondary transfer portion.

The recording medium S on which the toner image has been secondarily transferred from the intermediate transfer belt 6 is introduced to a fixing apparatus 50, i.e., an image heating apparatus, by passing through a conveyor path 10*b*. The fixing apparatus 50 fuses and presses the toner image to fix a full-color image on the recording medium S in a process of pinching and conveying the recording medium S while heating and pressing the recording medium S on which the toner image has been secondarily transferred.

The recording medium S sent out of the fixing apparatus 50 passes through a conveying path 10*c* and is discharged to a discharge tray 16 as a full-color print or a mono-color print.

(Fixing Apparatus)

Figure 2:
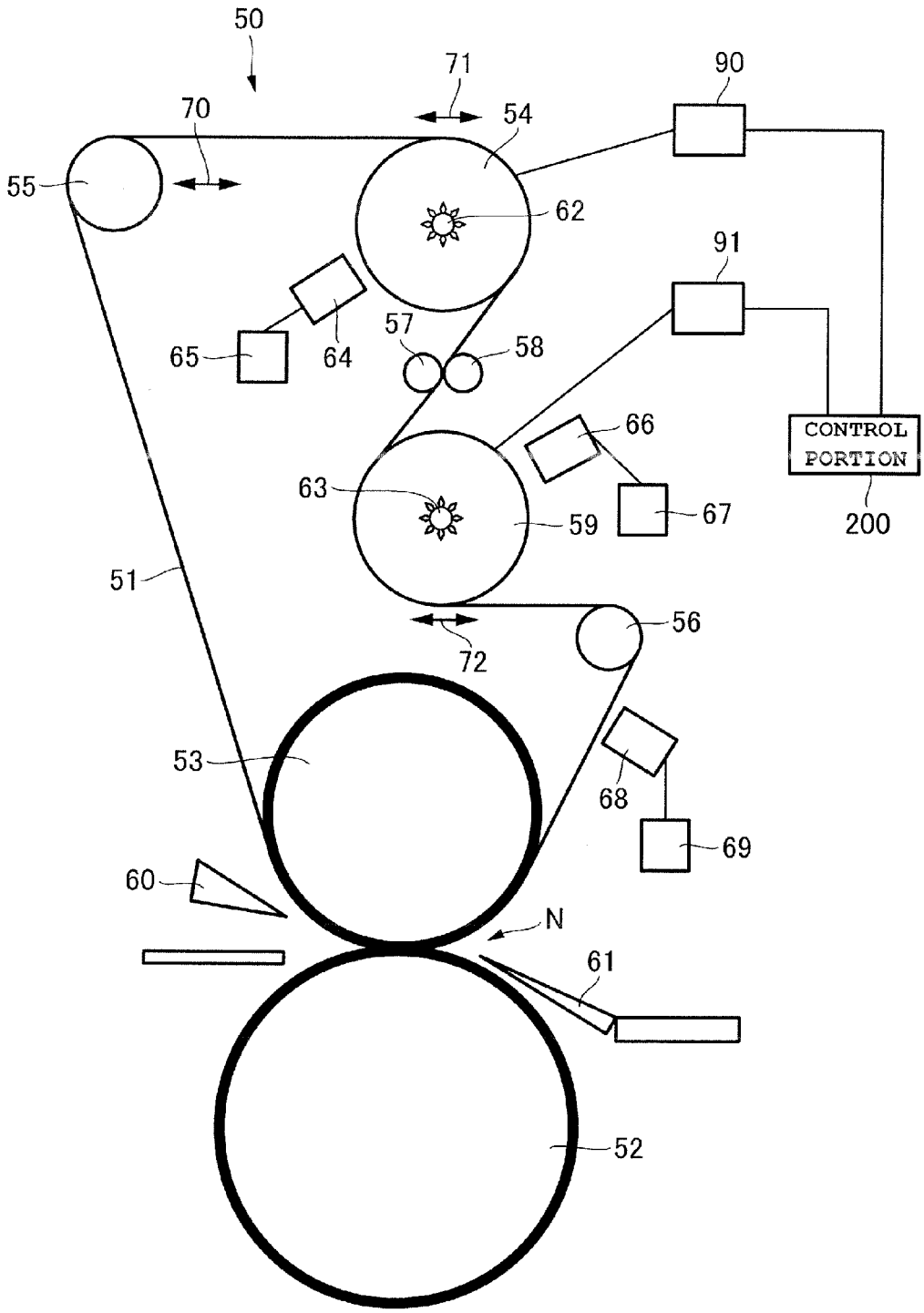
FIG. 2 is a schematic structural view of a fixing apparatus of a first embodiment of the invention.
Figure 3:
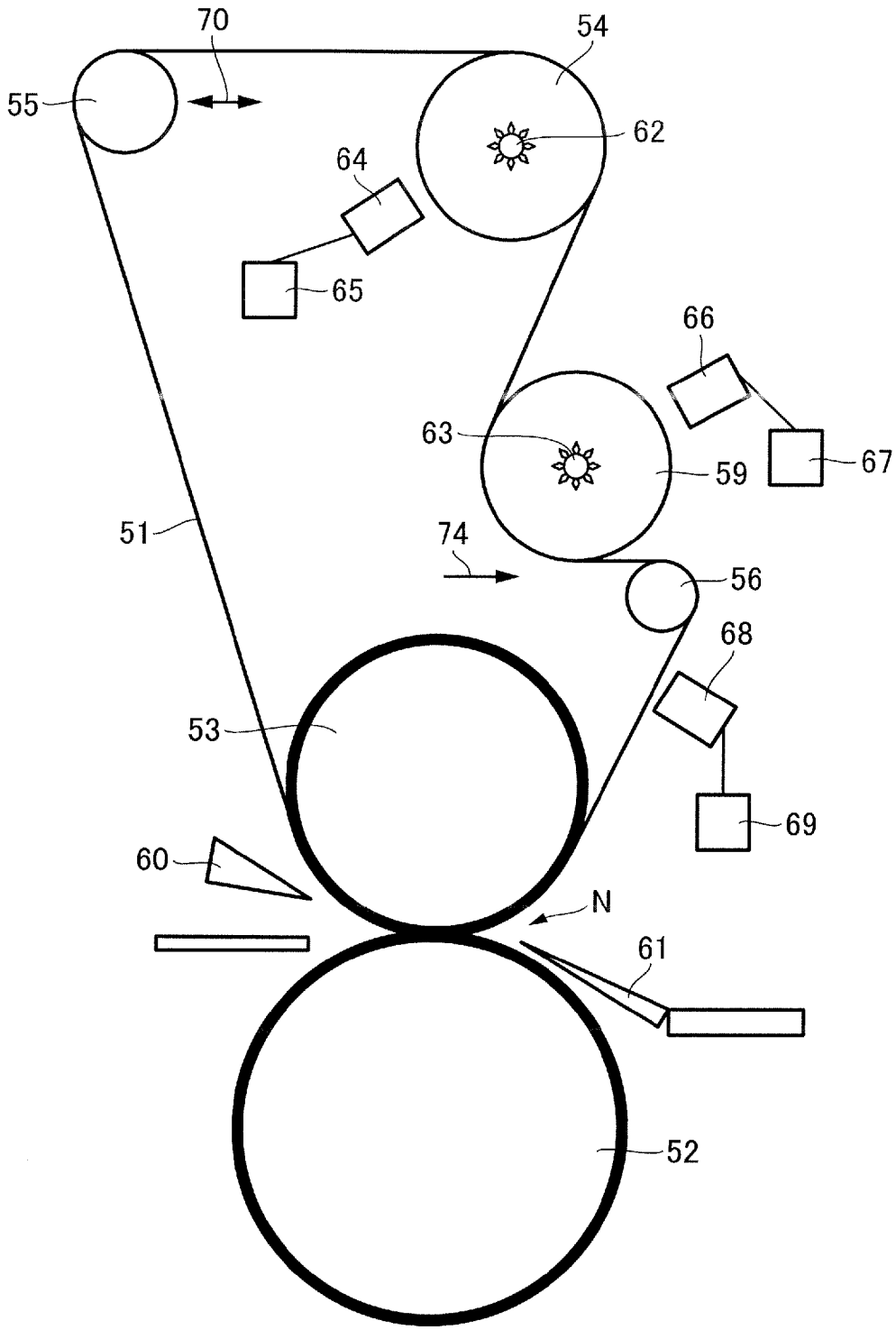
FIG. 3 is a schematic structural view of a modified example of the first embodiment of the fixing apparatus having no restricting member in which an outer heating roller is moved in a direction of an arrow.
Figure 4:
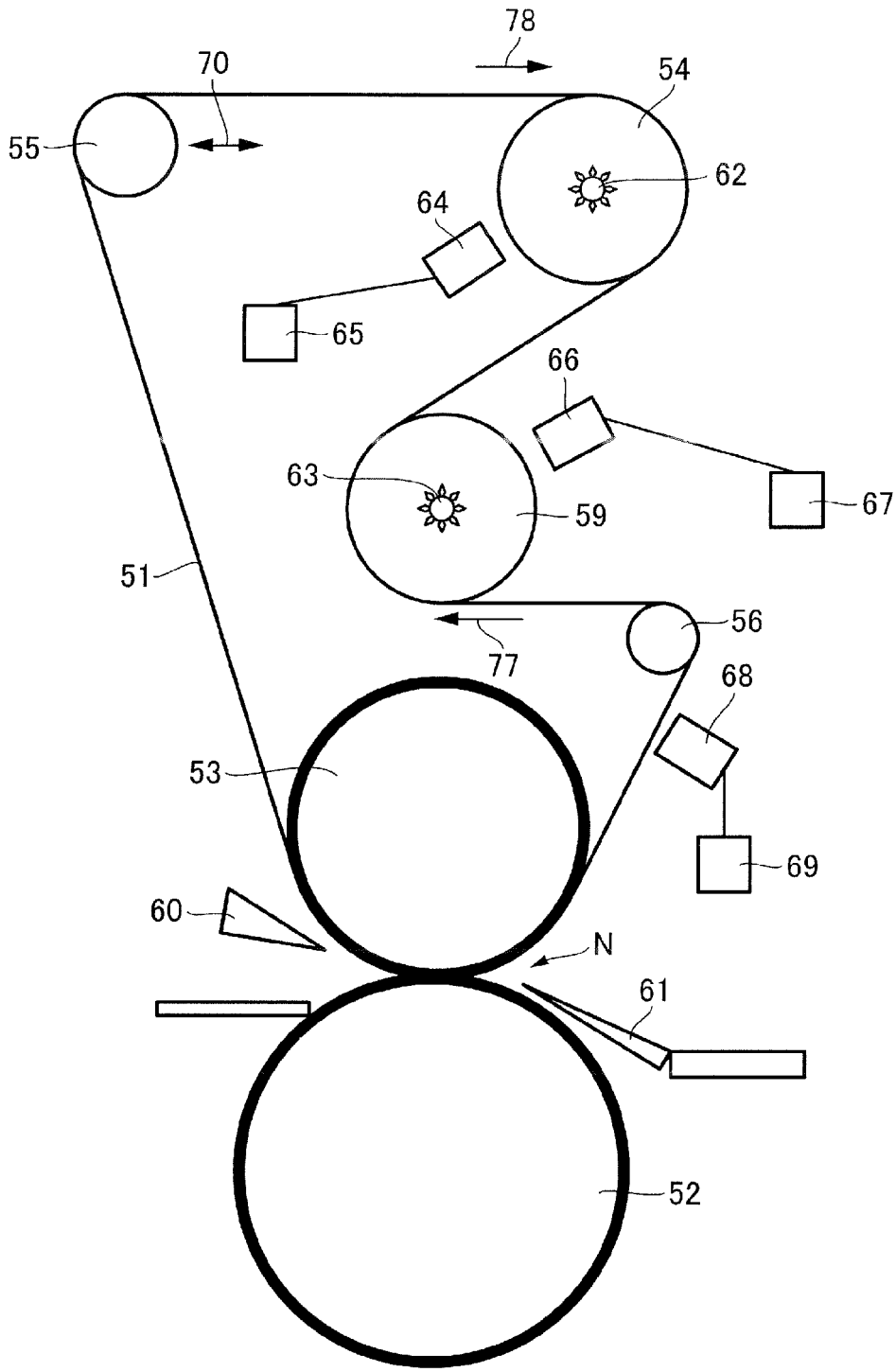
FIG. 4 is a schematic structural view of a modified example of the first embodiment of the fixing apparatus having no restricting member in which the inner and outer heating rollers are moved in directions of respective arrows.

The fixing apparatus 50 will now be described with reference to FIGS. 2 to 7. As shown in FIGS. 2 to 4, the fixing apparatus 50 includes a fixing belt 51 which is an endless heating belt configured to heat the toner image formed on the recording medium S as described above. To that end, the fixing apparatus 50 of the present embodiment includes an inner heating roller 54, an outer heating roller 59, and a pair of restricting members, i.e., restricting inner and outer rollers 57 and 58. The inner heating roller 54 is an inner heating member that is disposed at an inner side of the fixing belt 51 and is in contact with an inner circumferential surface of the fixing belt 51 to heat the fixing belt 51. The outer heating roller 59 is an outer heating member that is disposed at an outer side of the fixing belt 51 and is in contact with an outer circumferential surface of the fixing belt 51 to heat the fixing belt 51.

The restricting inner and outer rollers 57 and 58 are disposed such that they nip the fixing belt 51 between the inner and outer heating rollers 54 and 59 to restrict an orbit of the fixing belt 51. The restricting inner and outer rollers 57 and 58 are fixed at a position shown in FIG. 2 to restrict the position where the fixing belt 51 is nipped regardless whether the inner heating roller 54 or the outer heating roller 59 is moved as described later in the present embodiment.

The fixing apparatus 50 also includes a fixing roller 53, a pressure roller 52, a tension roller 55, and an auxiliary roller 56. The fixing roller 53 is a stretch roller disposed on the inner side of the endless fixing belt 51, besides the inner heating roller 54, to stretch the fixing belt 51. The pressure roller 52 is a member disposed on the outer side of the fixing belt 51, besides the outer heating roller 59, such that it counterfaces to the fixing roller 53 and nips the fixing belt 51 together with the fixing roller 53 to create a nip portion N through which the recording medium S on which an image has been formed passes.

The tension roller 55 is a first stretch roller that stretches the fixing belt 51 by being disposed on the inner side of the fixing belt 51 and on an opposite side of the restricting inner and outer rollers 57 and 58 with the inner heating roller 54 between the tension roller 55 and the restricting rollers 57 and 58. The tension roller 55 is movable in directions of an arrow 70 shown in FIG. 2 and urges the fixing belt 51 by an urging member such as a spring not shown to apply a predetermined tension to the fixing belt 51.

The auxiliary roller 56 is a second stretch roller that stretches the fixing belt 51 by being disposed on the inner side of the fixing belt 51 and on an opposite of the restricting inner and outer rollers 57 and 58 with the outer heating roller 59 between the auxiliary roller 56 and the restricting rollers 57 and 58. The auxiliary roller 56 is fixed at a position shown in FIG. 2 such that the fixing belt 51 is wrapped around the outer heating roller 59.

The tension and auxiliary rollers 55 and 56 are disposed such that they adjoin the inner and outer heating rollers 54 and 59, respectively, as described above in the present embodiment. This arrangement allows an inner area of contact between the fixing belt 51 and the inner heating roller 54 to be equalized with an outer area of contact between the fixing belt 51 and the outer heating roller 59 when the inner and outer heating rollers 54 and 59 are located at predetermined positions. This arrangement also makes it easy to change those areas of contact by moving the inner heating roller 54 or the outer heating roller 59 from the predetermined position as described later.

For instance, if there is no auxiliary roller 56 in the configuration shown in FIG. 2, it becomes difficult to assure the amount of the fixing belt 51 wrapped around the outer heating roller 59, and the inner area of contact may differ largely from the outer area of contact. In such a case, it becomes difficult to obtain an effect of changing the area of contact by moving the inner heating roller 54 or the outer heating roller 59 as described later. Accordingly, the tension and auxiliary rollers 55 and 56 are disposed as described above in the present embodiment. It is noted that the positions of the tension and auxiliary rollers 55 and 56 may be reversed from each other. The positions of the inner and outer heating rollers 54 and 59 may be also reversed from each other.

The fixing apparatus 50 will be described below more specifically. As shown in FIG. 2, the fixing apparatus 50 includes a separation claw 60 disposed on a recording medium outlet side of the nip portion N such that the claw 60 is in contact or in close contact with surfaces of the fixing belt and pressure roller 51 and 52, and a conveyance guide 61 that conveys a recording medium to the nip portion N.

The fixing belt 51 includes a base layer made of heat-resistant resin such as polyimide or metal such as stainless steel, Ni and others with a thickness around 20 to 100 μm. The fixing belt 51 also includes an elastic layer made of silicon rubber or the like with a thickness around 20 to 500 μm and formed around the base layer, and a PFA (tetrafluoroethyleneperfluoroalkyl) layer formed as a release layer around the elastic layer with a thickness around 30 to 100 μm.

The fixing roller 53 is constructed by a roller of 50 mm in diameter and has an elastic layer of 5 to 10 mm thick, made of sponge, heat-resistant silicon rubber or the like and wrapped around an aluminum metal core. The fixing roller 53 is rotationally driven by a driving motor, not shown. No heater as a heat source is disposed within the fixing roller 53 because the fixing belt 51 is heated by the inner and outer heating rollers 54 and 59 in the present embodiment. Therefore, it is not necessary to lower the thermal conductivity of the elastic layer of the fixing roller 53. This arrangement allows the elastic layer of the fixing roller 53 to be thickened, the sponge to be adopted as the elastic layer and a width of the nip portion to be increased.

The inner heating roller 54 is a roller of 30 mm in diameter in which a heat-resistant fluorine-coated release layer is covered on a surface of a metal core, i.e., a base layer, made of metal such as aluminum, iron or the like, and is configured to heat an inner surface of the fixing belt 51. A heat source 62 is disposed within the inner heating roller 54. The heat source 62 is a heat generating element, such as a halogen heater and heats the inner surface of the inner heating roller 54 by radiating infrared rays.

The fixing apparatus 50 also includes a temperature detecting element 64. Then, a temperature controller 65 detects the temperature of a surface of the inner heating roller 54 based on an output signal of the temperature detecting element 64 to control the heat source 62 such that the inner heating roller 54 has a predetermined temperature. The surface temperature of the inner heating roller 54 is controlled to be 220° C. in the present embodiment.

The inner heating roller 54 and the temperature detecting element 64 are arranged to be movable in the directions of an arrow 71 shown in FIG. 2 by a moving mechanism 90. The moving mechanism 90 may be a cam mechanism, not shown, constructed as follows, for example. That is, a support portion, not shown, configured to support the inner heating roller 54 and the temperature detecting element 64 may be supported to be movable in the directions of the arrow 71 by a guide rail or the like, not shown, provided on a case of the fixing apparatus 50 for example. The support portion is urged in either directions of the arrow 71 by an urging member such as a spring. The support portion is also arranged such that it comes into contact with the cam rotated by a motor, not shown, and such that the support portion is pushed in a direction opposite from the urging direction of the urging member, depending on a phase of the cam. This arrangement makes it possible to move the inner heating roller 54 and the temperature detecting element 64 in the directions of the arrow 71 by rotating the cam. Note that it is possible to arrange to move the inner heating roller 54 and the temperature detecting element 64 by an other mechanism, such as a feed screw mechanism, instead of the cam mechanism.

The fixing apparatus 50 is arranged to be able to change the area of contact (inner area of contact) between the fixing belt 51 and the inner heating roller 54 by moving the inner heating roller 54 by the moving mechanism 90 and to be able to change a quantity of heat applied from the inner heating roller 54 to the inner surface of the fixing belt 51 as described above in the present embodiment.

The outer heating roller 59 is a roller of 30 mm in diameter in which a heat-resistant fluorine-coated release layer is covered on a surface of a metal core, i.e., a base layer, made of metal such as aluminum, iron or the like, and is configured to heat an outer surface of the fixing belt 51. A heat source 63 is disposed within the outer heating roller 59. The heat source 63 is a heat generating element such as a halogen heater and heats an inner surface of the outer heating roller 59 by radiating infrared rays.

The fixing apparatus 50 also includes a temperature detecting element 66. Then a temperature controller 67 detects temperature of a surface of the outer heating roller 59 based on an output signal of the temperature detecting element 66 to control the heat source 63 such that the outer heating roller 59 has a predetermined temperature. The surface temperature of the outer heating roller 59 is controlled to be 220° C. in the present embodiment.

The outer heating roller 59 and the temperature detecting element 66 are arranged to be movable in directions of an arrow 72 shown in FIG. 2 by a moving mechanism 91. A configuration of the moving mechanism 91 is the same with that of the moving mechanism 90, so that an overlapped explanation thereof will be omitted here. The fixing apparatus 50 is arranged to be able to change the area of contact (outer area of contact) between the fixing belt 51 and the outer heating roller 59 by moving the outer heating roller 59 by the moving mechanism 91 and to be able to change a quantity of heat applied from the outer heating roller 59 to the outer surface of the fixing belt 51 as described above in the present embodiment.

The fixing apparatus 50 further includes a surface temperature detecting element 68. A member 69 for determining whether or not a sheet can be fed detects the surface temperature of the fixing belt 51 based on an output signal of the surface temperature detecting element 68 and causes a control portion 200 start to feed a sheet when the member 69 determines that the temperature of the fixing belt 51 has reached to a predetermined temperature.

The tension roller 55 is a roller made of stainless steel, is 16 mm in outer diameter, and applies predetermined tension to the fixing belt 51 even when the inner and outer heating rollers 54 and 59 are moved by moving in the directions of the arrow 70.

The auxiliary roller 56 is a roller made of stainless steel, is 12 mm in outer diameter, and is disposed such that it is in contact with an inner surface of the fixing belt 51 to change the orbit of the fixing belt 51 and to increase the area of contact between the fixing belt 51 and the outer heating roller 59.

The restricting inner and outer rollers 57 and 58 are stainless steel rollers of 10 mm in outer diameter and restrict the orbit of the fixing belt 51 by pinching the fixing belt 51 between them. This restriction of the orbit of the fixing belt 51 by the restricting inner and outer rollers 57 and 58 enables the apparatus to respectively change the inner and outer contact areas independently, by changing the positions of the inner and outer heating rollers 54 and 59. The changes of the contact areas of the fixing belt 51 with the inner and outer heating rollers 54 and 59 change quantities of heat applied to the inner and outer surfaces of the fixing belt 51.

The moving mechanisms 90 and 91 described above correspond to a changing means for changing at least either one of the area of contact between the fixing belt 51 and the inner heating roller 54 and the area of contact between the fixing belt 51 and the outer heating roller 59 in the present embodiment. That is, due to the restriction of the restricting inner and outer rollers 57 and 58, it is possible to change only the inner contact area by moving only the moving mechanism 90 and to change only the outer contact area by moving only the moving mechanism 91. It is also possible to change the both inner and outer contact areas by moving the moving mechanisms 90 and 91.

The point as to how the inner and outer contact areas can be changed, respectively, as described above by restricting the orbit of the fixing belt 51 by the restricting inner and outer rollers 57 and 58 will be described with reference to FIGS. 3 and 4.

FIGS. 3 and 4 show a modified example of the first embodiment of the fixing apparatus 50 including no restricting inner and outer rollers 57 and 58. It is possible to reduce an area of contact between the fixing belt 51 and the outer heating roller 59 by moving the outer heating roller 59 in a direction of an arrow 74 as shown in FIG. 3. In this case, however, an area of contact between the fixing belt 51 and the inner heating roller 54 is also reduced. Due to that, not only the temperature of the outer surface but also of the inner surface of the fixing belt 51 drop in the fixing apparatus 50 of the modified example, so that a downtime of the fixing apparatus 50 increases in feeding a thick sheet after feeding a thin sheet. Still further, even if a moving distance of the outer heating roller 59 is equal, variations of the contact areas are lessened when there are no restricting inner and outer rollers 57 and 58.

Meanwhile, it is possible to increase an area of contact between the fixing belt 51 and the outer heating roller 59 by moving the outer heating roller 59 in a direction of an arrow 77 and the inner heating roller 54 in a direction of an arrow 78 as shown in FIG. 4. However, an area of contact between the fixing belt 51 and the inner heating roller 54 also increases in the fixing apparatus 50 of the modified example. Due to that, temperatures of the both outer and inner surfaces of the fixing belt 51 increase, so that a downtime of the fixing apparatus 50 increases in feeding a thin sheet after feeding a thick sheet for example. Still further, if the inner heating roller 54 is returned to its original position in a direction opposite from the direction of the arrow 78 in order to reduce an area of contact between the fixing belt 51 and the inner heating roller 54, an area of contact between the fixing belt 51 and the outer heating roller 59 is also reduced. In this case, the temperature of not only the inner surface but also of the outer surface of the fixing belt 51 drop, so that a downtime of the fixing apparatus 50 in feeding a thick sheet after feeding a thin sheet increases.

In the case of the present embodiment, however, the area of contact between the fixing belt 51 and either one roller does not change, even if the other roller is moved by disposing the restricting inner and outer rollers 57 and 58 between the inner and outer heating rollers 54 and 59. In other words, this arrangement prevents the movement of one roller from affecting the positional relationship between the other roller and the fixing belt 51 by restricting the position of the fixing belt 51 between the inner and outer heating rollers 54 and 59. As a result, it becomes possible to independently change the inner and outer contact areas in the present embodiment and to shorten the downtime more effectively even in above situations.

Still further, the fixing belt 51 comes in contact in order of the inner heating roller 54, the restricting inner and outer rollers 57 and 58, and the outer heating roller 59 after passing through the nip portion N in the present embodiment. The fixing belt 51 comes in contact with the restricting inner and outer rollers 57 and 58 between the inner and outer heating rollers 54 and 59 to control the contact areas of the fixing belt 51 with the inner and outer heating rollers 54 and 59. Still further, while the heat of the inner surface of the fixing belt 51 tends to be hardly taken away because the ambient temperature of the inner surface is high, the heat of the outer surface of the fixing belt 51 tends to be taken away because the ambient temperature of the outer surface does not become high. Therefore, it is desirable to arrange the components of the apparatus such that the outer surface of the fixing belt 51 reaches the nip portion N in a shortest possible time after being heated by the outer heating roller 59.

To that end, the outer heating roller 59 is disposed such that it is in contact with the fixing belt 51 immediately before the nip portion N in a rotational direction of the fixing belt 51 in the present embodiment. It is noted that because the heat of the inner surface of the fixing belt 51 is hardly taken away as described above, the temperature of the inner surface of the fixing belt 51 drops less even if the inner heating roller 54 heats the fixing belt 51 at the position relatively distant from the nip portion N.

(Control Portion)

In the present embodiment, the control portion 200 shown in FIG. 2 controls the moving mechanisms 90 and 91 in order to move the inner and outer heating rollers 54 and 59 as described above. The control portion 200 estimates a basis weight of a recording medium from a type of the recording medium set by a user through an operating portion not shown of the image forming apparatus and controls the moving mechanisms 90 and 91 based on that basis weight.

For instance, the control portion 200 controls the moving mechanisms 90 and 91 so that an outer contact area becomes smaller than an inner contact area when the basis weight of the recording medium is less than a first predetermined amount, e.g., when the recording medium is a thin sheet. The control portion 200 also controls the moving mechanisms 90 and 91 so that an outer contact area becomes larger than an inner contact area when the basis weight of the recording medium is more than a second predetermined amount which is greater than the first predetermined amount, e.g., when the recording medium is a thick sheet.

It is noted that while the first and second predetermined amounts may be equal, it is preferable to set the predetermined amounts such that the second predetermined amount is greater than the first predetermined amount. It is because the following control may be made by defining a recording medium whose basis weight is less than the first predetermined amount is a thin sheet, a recording medium whose basis weight is greater than the first predetermined amount and less than the second predetermined amount is a normal sheet, and a recording medium whose basis weight is greater than the second predetermined amount is a thick sheet for example. Such control will be described specifically below with reference to FIGS. 5 to 7. Firstly, positions of the inner and outer heating rollers 54 and 59 set for the thin sheet will be explained by FIG. 5 and their positions set for the thick sheet will be explained by FIG. 6, respectively. It is noted that when the first predetermined amount is equal to the second predetermined amount, the control portion 200 discriminates a recording medium whether it is a thin sheet or not for example, i.e., in two steps, depending on whether or not the basis weight of the recording medium is greater than a predetermined amount. Then, when the basis weight of the recording medium is less than the predetermined amount, the control portion 200 controls the moving mechanisms 90 and 91 in the same manner with the case when the recording medium is a thin sheet as described above. When the basis weight of the recording medium is larger than the predetermined amount, the control portion 200 controls the moving mechanisms 90 and 91 in the same manner with the case when the recording medium is a thick sheet as described above.

(Positions Set for Thin Sheet)

Figure 5:
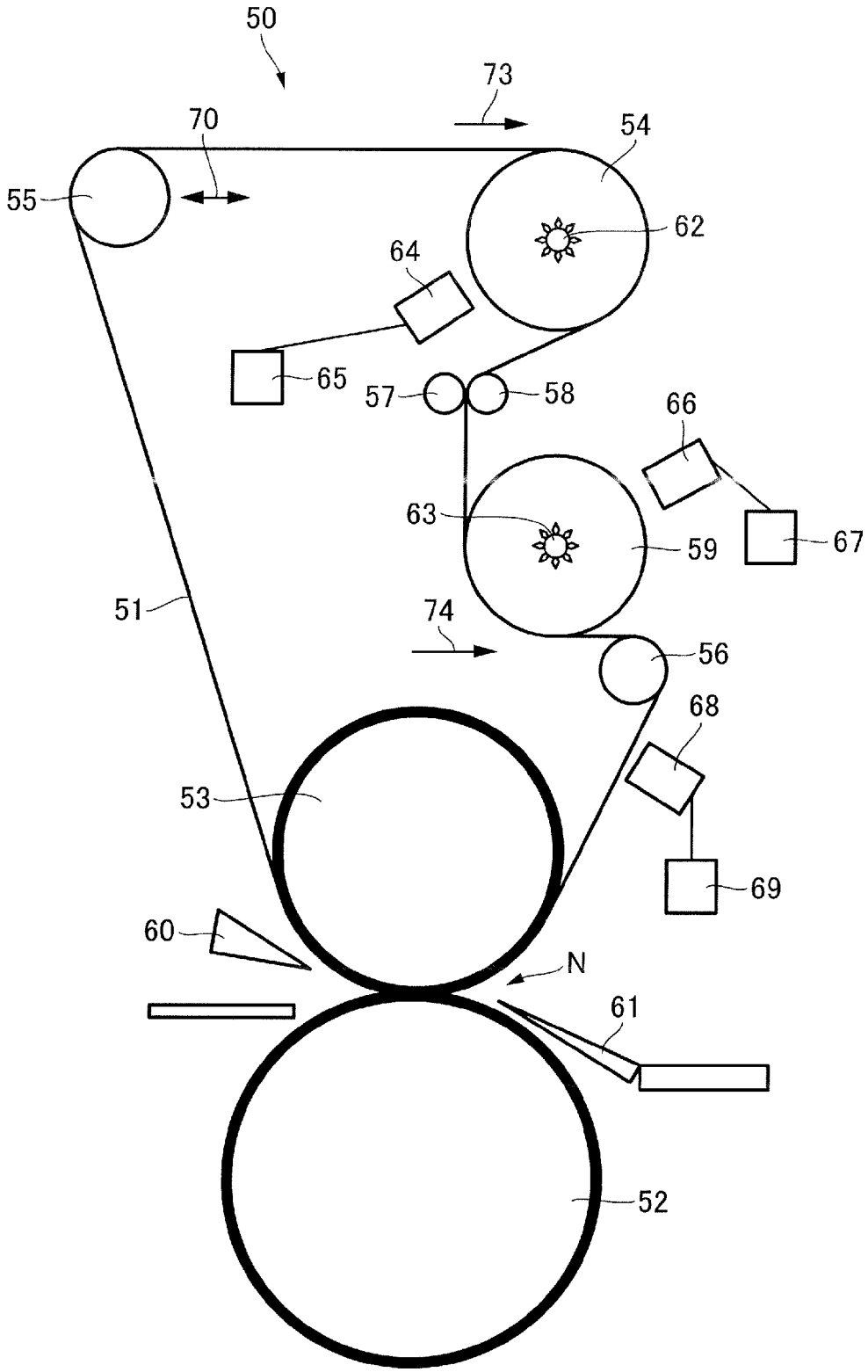
FIG. 5 is a schematic structural view of the fixing apparatus showing a state in which a thin sheet is fed.

FIG. 5 is a diagram for explaining a configuration of the fixing apparatus when the inner and outer heating rollers 54 and 59 are moved to positions to be set for a thin sheet. When a thin sheet is fed through the nip portion N, the quantity of heat taken away out of the outer surface of the fixing belt 51 in feeding the sheet is small because the thermal capacity of the recording medium S is small. Accordingly, the quantity of heat applied from the outer heating roller 59 to the outer surface of the fixing belt 51 can be less. Due to that, the outer heating roller 59 is moved in the direction indicated by the arrow 74 to reduce the area of contact between the fixing belt 51 and the outer heating roller 59 to be less than that in a standby condition. As a result, the quantity of heat applied from the outer heating roller 59 to the outer surface of the fixing belt 51 is reduced.

For instance, it is possible to reduce the contact area into a half of that in the standby condition or to zero the contact area, depending on a moving distance of the outer heating roller 59. It is noted that the standby condition is a condition in which the inner and outer heating rollers 54 and 59 are located at positions for feeding a normal sheet where the inner and outer contact areas are substantially equalized.

The inner heating roller 54 is also moved in the direction indicated by the arrow 73 in the present embodiment. Then, the area of contact between the fixing belt 51 and the inner heating roller 54 is increased to be more than that in the standby condition to increase a quantity of heat applied from the inner heating roller 54 to the inner surface of the fixing belt 51 due to the following reason.

That is, it is possible to reduce the quantity of heat applied to the inner surface (inner circumferential surface) of the fixing belt 51 if only a thin sheet is fed. However, if the quantity of heat applied from the both rollers is reduced, it takes time to increase the temperature of the fixing belt 51, thus prolonging the downtime, in feeding a normal sheet or a thick sheet next. If the quantity of heat to be applied to the outer surface (outer circumferential surface) of the fixing belt 51 is increased in order to shorten the downtime, the temperature of the outer surface of the fixing belt 51 rises. Then, a so-called high-temperature offset may occur when a toner image melts too much, or sheet wrinkles may occur due to an excessive quantity of heat applied to the recording medium S. Then, the inner area of contact between the fixing belt 51 and the inner heating roller 54 that heats the inner circumferential surface of the fixing belt 51, which less strongly affects the outer surface of the fixing belt 51, is increased to increase the quantity of heat stored in the fixing belt 51 in the present embodiment. Thus, the downtime in changing over from a thin sheet to a normal sheet or a thick sheet is shortened.

(Position Set for Thick Sheet)

Figure 6:
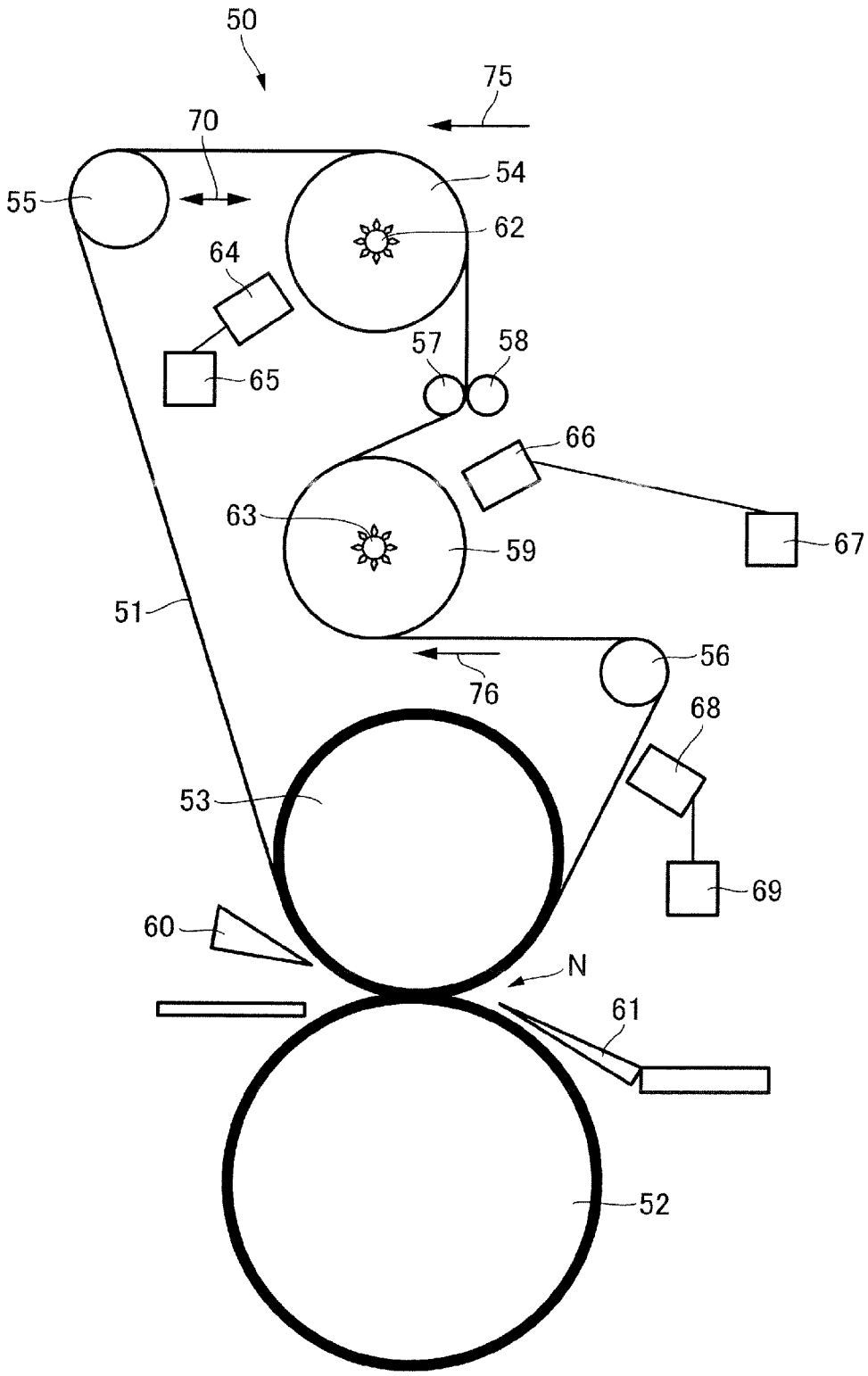
FIG. 6 is a schematic structural view of the fixing apparatus showing a state in which a thick sheet is fed.

FIG. 6 is a diagram explaining a configuration of the fixing apparatus 50 when the inner and outer heating rollers 54 and 59 are moved to positions to be set for a thick sheet. When the thick sheet is fed through the nip portion N, the quantity of heat taken away from the outer surface of the fixing belt 51 is large because the thermal capacity of the recording medium S is large. Therefore, it is necessary to increase the quantity of heat to be applied from the outer heating roller 59 to the outer surface of the fixing belt 51. To that end, the outer heating roller 59 is moved in a direction indicated by an arrow 76 to increase the area of contact between the fixing belt 51 and the outer heating roller 59 to be larger than that in the standby condition in the present embodiment. Thus, the quantity of heat applied from the outer heating roller 59 to the outer surface of the fixing belt 51 is increased.

The inner heating roller 54 is also moved in a direction indicated by an arrow 75 in the present embodiment to reduce an area of contact between the fixing belt 51 and the inner heating roller 54 to be smaller than that in the standby condition so that a quantity of heat applied from the inner heating roller 54 to the inner circumferential surface of the fixing belt 51 is reduced, due to the following reason.

That is, it is possible to increase the quantity of heat applied to the inner surface (inner circumferential surface) of the fixing belt 51 if only the thick sheet is fed through the nip portion N. However, if the quantities of heat applied from the both rollers are increased, it takes time to lower the temperature of the fixing belt 51 in feeding a normal sheet or a thin sheet next, thus prolonging the downtime. When the quantity of heat applied to the outer surface (outer circumferential surface) of the fixing belt 51 is reduced on the other hand, the temperature of the outer surface of the fixing belt 51 drops. Then, it may cause a so-called low-temperature offset that occurs when a toner image cannot be fully melted. Therefore, the inner area of contact between the fixing belt 51 and the inner heating roller 54 that heats the inner circumferential surface of the fixing belt 51, which less strongly affects the outer surface of the fixing belt 51, is reduced to reduce the quantity of heat stored in the fixing belt 51 in the present embodiment. Then, the downtime that takes in changing over from a thick sheet to a normal sheet or a thin sheet is shortened.

(Flow of Control)

One exemplary flow of control of the present embodiment will now be described with reference to FIG. 7. When there is no print job, the fixing apparatus stands by in the standby condition in Step S1. In the Step S1, the outer and inner heating rollers 59 and 54 are disposed at the positions shown in FIG. 2. In this case, the temperature of the outer surface of the fixing belt 51, detected by a surface temperature detecting element 68, is about 190° C. by quantities of heat applied from the outer and inner heating rollers 59 and 54. When a print job is started from the standby condition in Step S2, the control portion 200 confirms the basis weight of the recording medium S to be fed through the nip portion N in Step S3. When a thin sheet whose basis weight is less than 63 g/m$^2$ (first predetermined amount) is to be fed through as the recording medium S, the control portion 200 moves the outer and inner heating rollers 59 and 54 respectively to the positions set for a thin sheet as shown in FIG. 5 in Steps S4 and 5.

When the outer and inner heating rollers 59 and 54 move to the positions set for the thin sheet, the quantity of heat to be applied to the outer surface of the fixing belt 51 decreases considerably, so that the temperature of the outer surface of the fixing belt 51 drops sharply to a temperature equilibrated by the quantity of heat applied. The surface temperature detecting element 68 of the fixing belt 51 confirms whether or not the temperature of the outer surface of the fixing belt 51 has dropped from 190° C., which is the temperature at the standby time, to 160° C. in Step S6. The surface temperature detecting element 68 confirms if the detected temperature is within a range more than 150° C. and less than 160° C. in Step S6.

If the detected temperature has not dropped yet to 160° C. in Step S6, i.e., the temperature detected by the surface temperature detecting element 68 is higher than 160° C., the fixing apparatus 50 is idled for a predetermined time in Step S7 and is then returned to Step S6. When it is confirmed that the surface temperature of the fixing belt 51 has dropped to be less than 160° C. in Step S6, the sheet is started be fed to the fixing apparatus 50 in Step S8 to fix the image. Sheets are fed continuously through such steps until when a job for forming images on thin sheets ends in Steps S9 and S10.

The quantity of heat taken away from the outer surface of the fixing belt 51 is small in feeding the thin sheet because the thermal capacity of the recording medium S is small. Therefore, even if the area of contact between the outer surface of the fixing belt 51 and the outer heating roller 59 is small, the temperature of the outer surface of the fixing belt 51 drops less in feeding the thin sheet and the temperature drifts above 150° C. When the job ends, the control portion 200 ends feeding a sheet in Step S11, returns the outer and inner heating rollers 59 and 54 to the positions of the standby condition in Steps S12 and S13, and shifts the status of the fixing apparatus 50 to the standby condition in Step S14.

As a result, the area of contact between the fixing belt 51 and the outer heating roller 59 increases and the temperature of the outer surface of the fixing belt 51 rises to 190° C., i.e., a temperature equilibrated by the quantity of heat applied. The area of contact between the inner surface of the fixing belt 51 and the inner heating roller 54 is increased in feeding a thin sheet in the present embodiment. Due to that, a large quantity of heat is applied to the inner surface of the fixing belt 51 and the temperature of the inner surface is kept high, so that the temperature of the fixing belt 51 reaches the temperature of the standby condition in a short time.

Next, when the control portion 200 confirms that a normal sheet whose basis weight is more than 63 g/m$^2$ and is less than 209 g/m$^2$ is to be fed as a recording medium S in Step S3, the control portion 200 does not move the both rollers because the positions of the outer and inner heating rollers 59 and 54 may be those in the standby condition. Then, the control portion 200 confirms that the temperature of the fixing belt 51 detected by the surface temperature detecting element 68 is more than 180° C. and less than 190° C. (180 to 190° C.) in Step S15. It is normally possible to start feeding the sheet immediately because the standby temperature is 190° C. However, there is a case when the temperature is not within the range of 180 to 190° C. when a thin sheet feeding or thick sheet feeding job has been carried out immediately before the normal sheet feeding job. Due to that, in such a case, the fixing apparatus 50 is idled until when the temperature detected by the surface temperature detecting element 68 falls within the range of 180 to 190° C. in Step S16. When the temperature of the outer surface of the fixing belt 51 falls within the range from 180 to 190° C., the control portion 200 starts to feed the normal sheet to the fixing apparatus 50 in Step S17 and continues feeding normal sheets until the job ends in Steps S18 and S19. When the job ends, the control portion 200 ends feeding in Step S20, and shifts to the standby condition as it is in Step S14.

Next, when the control portion 200 confirms that a thick sheet whose basis weight is more than 209 g/m$^2$ (second predetermined amount) is to be fed as a recording medium S in Step S3, the control portion 200 moves the outer and inner heating rollers 59 and 54 respectively to the positions set for a thick sheet shown in FIG. 6 in Steps S21 and S22.

When the outer and inner heating rollers 59 and 54 are moved to the positions set for a thick sheet, the quantity of heat applied to the outer surface of the fixing belt 51 increases considerably, so that the surface temperature of the fixing belt 51 sharply rises to a temperature equilibrated by the quantity of heat applied. Then the control portion 200 confirms whether the temperature of the outer surface of the fixing belt 51 has risen from 190° C., which is the temperature in the standby condition, to 210° C. by the surface temperature detecting element 68 of the fixing belt 51 in Step S23. The control portion 200 confirms whether or not the temperature detected by the surface temperature detecting element 68 is within a range more than 200° C. and less than 210° C. in Step S23.

When the temperature has not risen to 200° C. in Step S23, i.e., the temperature detected by the surface temperature detecting element 68 is lower than 200° C., the control portion 200 idles the fixing apparatus 50 for a predetermined time in Step S24 and returns to Step S23. When the control portion 200 confirms that the surface temperature of the fixing belt 51 has risen to 200° C. or more in Step S23, the control portion 200 starts to feed the thick sheet to the fixing apparatus 50 in Step S25 to fix an image. The control portion 200 continues such steps of feeding thick sheets until when the job for forming images on the thick sheets ends in Steps S26 and S27.

Because the thermal capacity of the recording medium S is large in the case of feeding a thick sheet, a large quantity of heat is taken away from the outer surface of the fixing belt 51 in feeding such sheet. However, because the area of contact between the outer surface of the fixing belt 51 and the outer heating roller 59 is large, the temperature of the outer surface of the fixing belt 51 drops less in feeding the sheet and drifts above 200° C. When the job ends, the control portion 200 ends feeding a sheet in Step S28, returns the outer and inner heating rollers 59 and 54 to the positions in the standby condition in Steps S29 and S30, and shifts the status of the fixing apparatus 50 to the standby condition in Step S14.

As a result, the area of contact between the fixing belt 51 and the outer heating roller 59 becomes small and the temperature of the outer surface of the fixing belt 51 drops 190° C., i.e., the temperature equilibrated by the quantity of heat applied. The area of contact between the inner surface of the fixing belt 51 and the inner heating roller 54 is reduced in feeding a thick sheet in the present embodiment. Due to that, the quantity of heat applied to the inner surface of the fixing belt 51 is reduced and the temperature of the inner surface of the fixing belt 51 is kept low, so that the temperature of the fixing belt 51 drops to the temperature in the standby condition in a short time.

Figure 7:
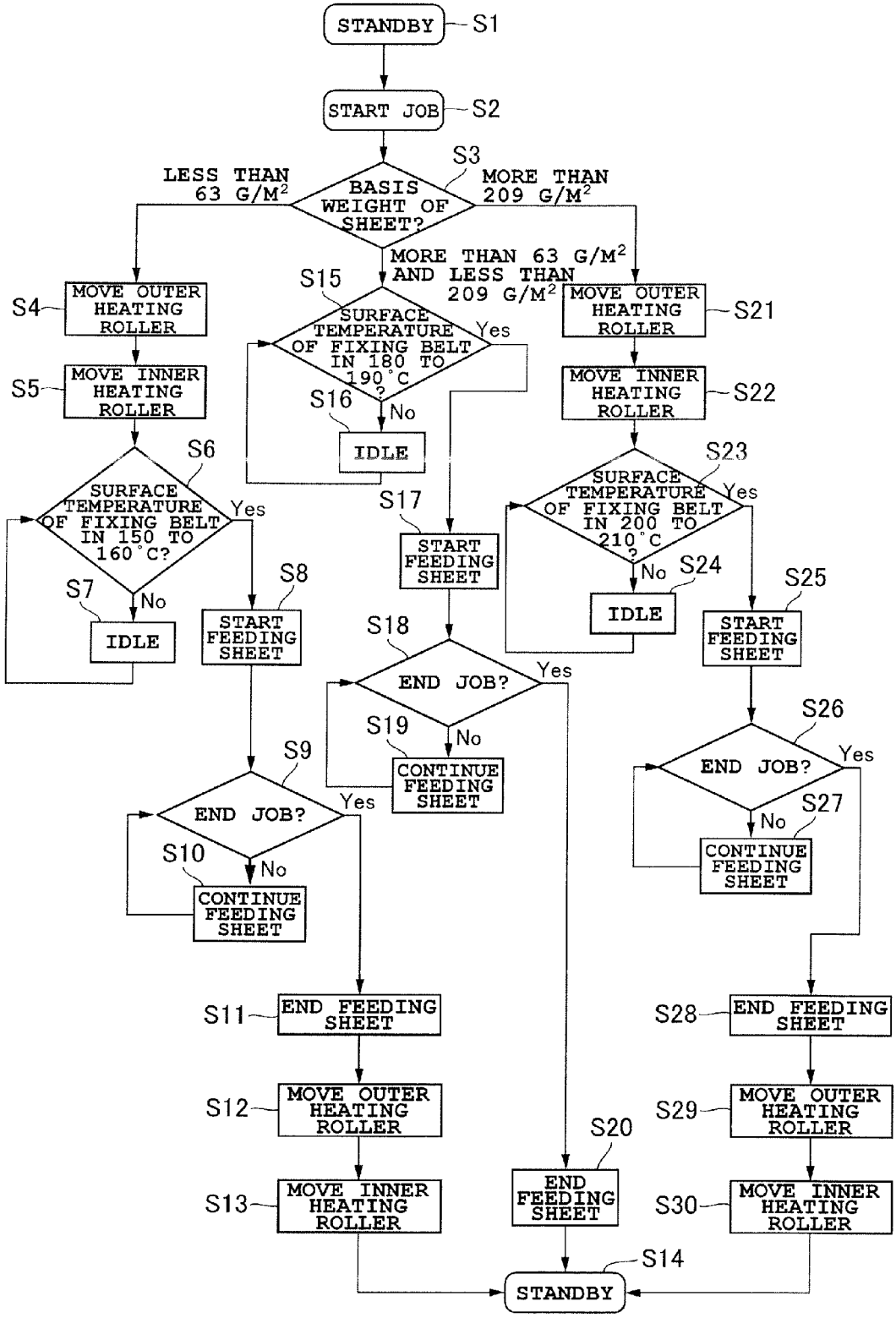
FIG. 7 is a flowchart showing a flow of control of the fixing apparatus of the first embodiment.

While the status of the fixing apparatus 50 is returned to the standby condition after ending the job for a thin sheet job or the job for a thick sheet in the description of the flow of control shown in FIG. 7, the outer and inner heating rollers 59 and 54 may be moved to the positions for the respective recording media without returning to the standby condition when a job for a thick sheet is to be carried out after ending a job for a thin sheet, and vice versa.

Still further, the quantity of heat applied from the inner heating roller 54 to the inner surface of the fixing belt 51 is reduced when the quantity of heat applied from the outer heating roller 59 to the outer surface of the fixing belt 51 is increased in the present embodiment. However, it is also possible to increase the quantity of heat applied from the inner heating roller 54 to the inner surface of the fixing belt 51 in combination with what has been described above when a recording medium has a very large thermal capacity.

Although only the temperature of the outer surface of the fixing belt 51 is detected by the surface temperature detecting element 68 in the present embodiment, a temperature detecting element may be provided also on the inner surface of the fixing belt 51. Then, quantities of heat applied from the outer and inner heating rollers 59 and 54 to the fixing belt 51 may be controlled by detecting respective temperatures of the outer and inner surfaces of the fixing belt 51. In this case, the temperature detecting elements 64 and 66 may be eliminated. This arrangement makes it possible to more accurately control the quantities of heat to be applied and to reduce the downtime further.

The temperatures of the heat sources 62 and 63 are set at constant temperature regardless of the types of recording media in the present embodiment. However, the controls for changing over the temperatures of the heat sources 62 and 63 in accordance to the types of recording media may be also made simultaneously with the controls for moving the rollers described above. For instance, a preset temperature of the heat source 63 of the outer heating roller 59 in feeding a thin sheet may be set to be lower than the temperature in feeding a normal sheet. In this case, a preset temperature of the heat source 62 of the inner heating roller 54 may be set to be equal to or higher than the temperature in feeding a normal sheet. However, the preset temperature of the heat source 63 of the outer heating roller 59 in feeding a thick sheet is raised to be higher than a temperature in feeding a normal sheet. In this case, a preset temperature of the heat source 62 of the inner heating roller 54 may be set to be equal to or lower than the temperature in feeding a normal sheet.

According to the present embodiment configured as described above, the quantity of heat applied by the fixing belt 51 can be changed swiftly by changing at least either one of the area of contact between the fixing belt 51 and the inner heating roller 54 and the area of contact between the fixing belt 51 and the outer heating roller 59. That is, it is possible to enhance the effect of reducing the downtime in a job in which temperature of the fixing belt 51 is required to be largely changed. For instance, it is possible to considerably reduce the downtime in carrying out a job for a thin sheet immediately after a job for a thick sheet or a job for a thick sheet immediately after a job for a thin sheet. Due to that, it is possible to maintain productivity even if images are formed while properly using different types of recording media.

For instance, although it is also possible to change the quantities of heat to be applied to the fixing belt 51 just by changing the preset temperatures of the inner and outer heating rollers 54 and 59, it takes a certain amount of time until when the changes of the preset temperatures of the rollers are reflected to the fixing belt 51. When it is required to lower the temperature to reduce the quantities of heat to be applied in particular, it is unable to rapidly lower the temperature and to rapidly reduce the quantities of heat to be applied because the inner and outer heating rollers 54 and 59 have certain thermal capacities.

However, it is possible to rapidly change the quantities of heat to be applied to the fixing belt 51 by reducing the contact areas of the fixing belt 51 with the inner and outer heating rollers 54 and 59 by moving the inner and outer heating rollers 54 and 59 as described above in the present embodiment. For instance, it is also possible to zero the quantity of heat to be applied by moving the rollers in directions of separating the rollers from the fixing belt 51. Thus, it is possible to quickly change the quantities of heat to be applied by changing the contact areas of the fixing belt 51 with the inner and outer heating rollers 54 and 59, and as a result, it is possible to quickly change the temperature of the fixing belt 51. Accordingly, it is possible to reduce the downtime required in changing over the types of sheet to be fed and in changing over the temperatures of the fixing belt 51.

Second Embodiment

Figure 8:
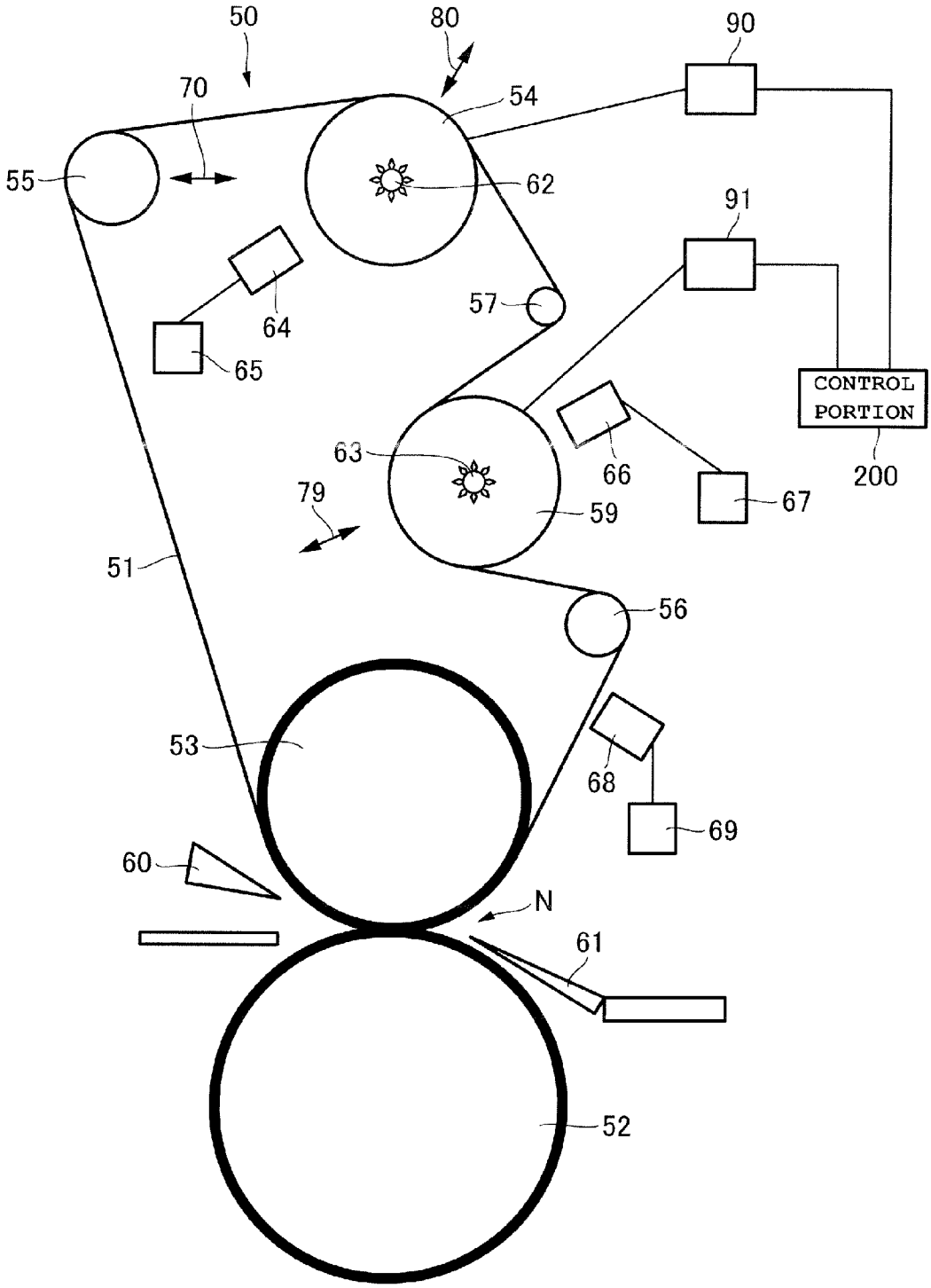
FIG. 8 is a schematic structural view of a fixing apparatus according to a second embodiment of the invention.

A second embodiment of the invention will be described with reference to FIG. 8. While the pair of rollers of the restricting inner and outer rollers 57 and 58 is described as the restricting members in the first embodiment described above, only the restricting inner roller 57 is provided and the inner and outer heating rollers 54 and 59 are arranged such that the inner heating roller 54 moves in directions of an arrow 80 and the outer heating roller 59 moves in directions of an arrow 79 as shown in FIG. 8 in the present embodiment. In short, the restricting inner roller 57 is disposed such that the moving directions of the inner and outer heating rollers 54 and 59 are differentiated and the move of one roller hardly affects the other roller. The other configurations and operations are the same with those of the first embodiment described above.

Third Embodiment

Figure 9:
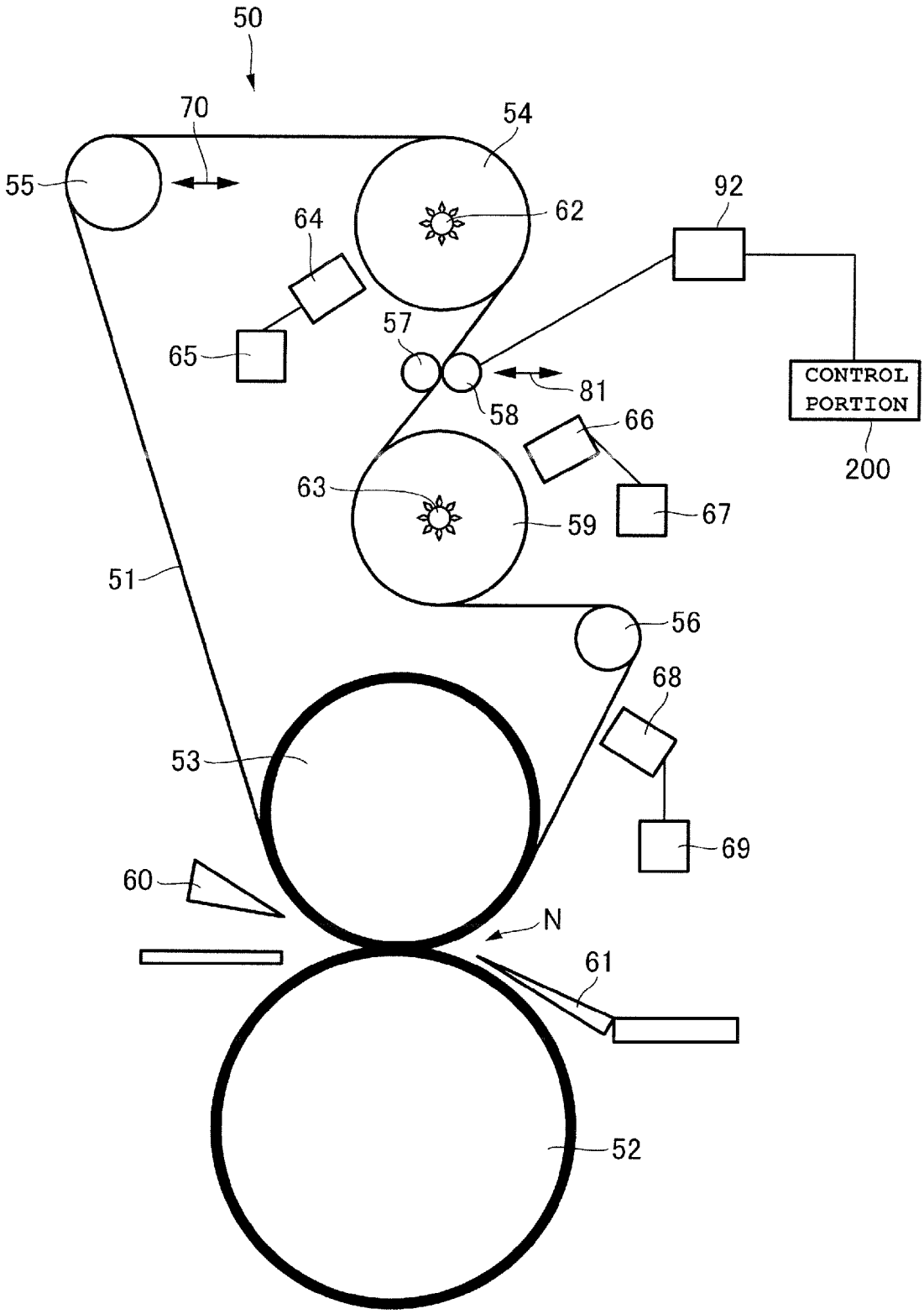
FIG. 9 is a schematic structural view of a fixing apparatus according to a third embodiment of the invention.

A third embodiment of the invention will be described with reference to FIG. 9. While the restricting inner and outer rollers 57 and 58 are fixed and the outer and inner heating rollers 59 and 54 are moved to control quantities of heat in the first and second embodiment described above, the outer and inner heating rollers 59 and 54 are fixed and the restricting inner and outer rollers 57 and 58 are moved in directions of an arrow 81 in the present embodiment as shown in FIG. 9. Therefore, the restricting inner and outer rollers 57 and 58 are arranged to be movable in the directions of the arrow 81 by a moving mechanism 92 to change contact areas of the fixing belt 51 with the outer and inner heating rollers 59 and 54, respectively.

For instance, it is possible to increase the quantity of heat applied from the outer heating roller 59 to the outer surface of the fixing belt 51 and to reduce the quantity of heat applied from the inner heating roller 54 to the inner surface of the fixing belt 51 by moving the restricting inner and outer rollers 57 and 58 in a right direction of the arrow 81 in FIG. 9 in feeding a thick sheet. It is also possible to reduce the quantity of heat applied from the outer heating roller 59 to the outer surface of the fixing belt 51 and to increase the quantity of heat applied from the inner heating roller 54 to the inner surface of the fixing belt 51 by moving the restricting inner and outer rollers 57 and 58 in a left direction of the arrow 81 in FIG. 9 in feeding a thin sheet. The other configurations and operations of the present embodiment are the same with the first embodiment described above.

Fourth Embodiment

Figure 10:
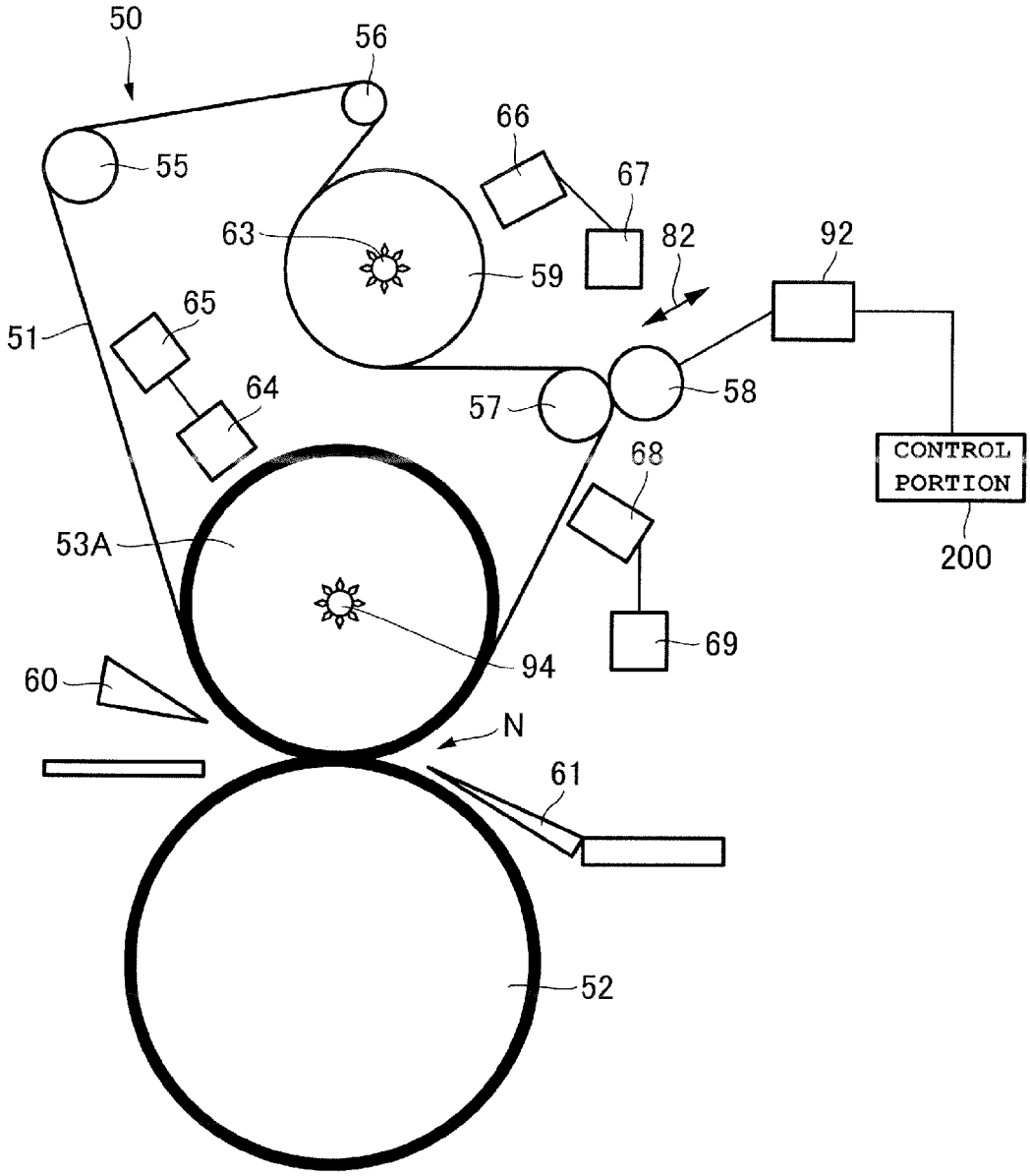
FIG. 10 is a schematic structural view of a fixing apparatus according to a fourth embodiment of the invention.

A fourth embodiment of the invention will be described with reference to FIG. 10. The inner heating roller and the fixing roller are provided as separate members in the embodiments described above. In a case of the present embodiment however, a fixing roller 53A is used also as an inner heating member as shown in FIG. 10. That is, a heat source 94 such as a halogen heater is provided within the fixing roller 53A to heat the inner surface of the fixing belt 51. Similarly to the third embodiment, the outer heating roller 59 and the fixing roller 53A, i.e., the inner heating roller, are fixed and the restricting inner and outer rollers 57 and 58 are moved in directions of an arrow 82 in the present embodiment.

In the case of the present embodiment, the tension roller 55 is disposed on a side opposite from the restricting inner and outer rollers 57 and 58 with the fixing roller 53A between them. The auxiliary roller 56 is disposed on a side opposite from the restricting inner and outer rollers 57 and 58 with the outer heating roller 59 between them. Because the fixing roller 53A is used also as the inner heating member in the present embodiment, it is possible to reduce a number of parts as compared to the respective embodiments described above. The other configurations and operations are the same with those of the first and third embodiments described above.

Other Embodiment

The respective embodiments described above can be combined appropriately. For instance, it is also possible to arrange to move the restricting inner and outer rollers 57 and 58, in addition to the moves of the inner and outer heating rollers 54 and 59, to control quantities of heat applied to the fixing belt 51. Still further, it is also possible to arrange to move either one of the outer heating roller 59 and the inner heating roller 54. In this case, either one of an area of contact between the fixing belt 51 and the inner heating roller 54 and an area of contact between the fixing belt 51 and the outer heating roller 59 is changed. Still further, other than the rollers described above, the restricting member can be composed of some other rotating member such as a belt or a guide member such as a guide plate. The pressure roller 52, i.e., the counterface member, can be any member, such as a pressure belt and a pressure pad, as long as it nips the fixing belt (heating belt) 51 and creates the nip portion together with the fixing roller 53. Still further, while the fixing apparatus configured to fix a non-fixed toner image on a recording medium has been explained as the image heating apparatus in the embodiments described above, the image heating apparatus of the invention may be also carried out as a heat processing apparatus configured to modulate properties of a surface of an image by heating and pressing a recording medium carrying a fixed image or a semi-fixed image. The recording medium may be a copy sheet, an electro-facsimile sheet, an electrostatic recording sheet, an OHP sheet, a printing sheet, a format sheet, an envelope, and others.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-091973, filed on Apr. 13, 2012, which is hereby incorporated by reference herein in its entirety.

What is claimed is:

1. An image heating apparatus, comprising:

an endless heating belt configured to heat an image formed on a recording medium;

an inner heating member that is disposed at an inner side of the endless heating belt and is in contact with an inner circumferential surface of the heating belt to heat the heating belt;

an outer heating member that is disposed at an outer side of the endless heating belt and is in contact with an outer circumferential surface of the heating belt to heat the heating belt;

a restricting member disposed between the inner and outer heating members to restrict an orbit of the heating belt; and a moving mechanism configured to move at least one of the inner heating member, the outer heating member, and the restricting member to change at least either one of an area of contact between the heating belt and the inner heating member and an area of contact between the heating belt and the outer heating member.

2. The image heating apparatus according to claim 1, wherein the restricting member is a pair of restricting rollers that pinch the heating belt.

3. The image heating apparatus according to claim 1, further comprising:

a fixing roller disposed at the inner side of the endless heating belt, besides the inner heating member, to stretch the heating belt; and a counterface member disposed at the outer side of the endless heating belt, besides the outer heating member, to pinch the heating belt with the fixing roller and to form a nip portion through which a recording medium on which an image has been formed passes.

4. The image heating apparatus according to claim 3, wherein the fixing roller lacks a heat source for heating the heating belt.

5. The image heating apparatus according to claim 3, further comprising:

a first stretch roller disposed on the inner side of the heating belt and on a side opposite from the restricting member with the inner heating member between them to stretch the heating belt; and a second stretch roller disposed on the inner side of the heating belt and on a side opposite from the restricting member with the outer heating member between them to stretch the heating belt, wherein either one of the first and second stretch rollers is a tension roller that adjusts tension of the heating belt.

6. The image heating apparatus according to claim 1, wherein the inner heating member comprises a fixing roller that is disposed on the inner side of the heating belt and stretches the heating belt, wherein the apparatus further comprises a counterface member that is disposed on the outer side of the heating belt to pinch the heating belt with the fixing roller and to form a nip portion through which a recording medium on which an image has been formed passes.

7. The image heating apparatus according to claim 3, wherein the moving mechanism comprises:

a first moving mechanism configured to move the inner heating member to change an area of contact between the heating belt and the inner heating member; and a second moving mechanism configured to move the outer heating member to change an area of contact between the heating belt and the outer heating member.

8. The image heating apparatus according to claim 3, wherein the moving mechanism moves the restricting member to change an area of contact between the heating belt and the inner heating member and an area of contact between the heating belt and the outer heating member.

9. The image heating apparatus according to claim 6, wherein the moving mechanism moves the restricting member to change an area of contact between the heating belt and the inner heating member and an area of contact between the heating belt and the outer heating member.

10. An image forming apparatus, comprising:

an image forming unit configured to form an image on a recording medium; and an image heating apparatus, as described in claim 1, configured to heat the recording medium on which the image has been formed.

11. The image forming apparatus according to claim 10, further comprising a control portion configured to control the moving mechanism such that an area of contact between the heating belt and the outer heating member is smaller than an area of contact between the heating belt and the inner heating member when the basis weight of the recording medium is less than a first predetermined amount and such that an area of contact between the heating belt and the outer heating member is greater than an area of contact between the heating belt and the inner heating member when the basis weight of the recording medium is more than a second predetermined amount, which is greater than the first predetermined amount.

12. The image forming apparatus according to claim 11, wherein the control portion controls the moving mechanism such that an area of contact between the heating belt and the outer heating member is substantially equalized with an area of contact between the heating belt and the inner heating member when the basis weight of the recording medium is more than the first predetermined amount and less than the second predetermined amount.

13. The image forming apparatus according to claim 10, further comprising a control portion configured to control the moving mechanism such that an area of contact between the heating belt and the outer heating member is smaller than an area of contact between the heating belt and the inner heating member when the basis weight of the recording medium is less than a predetermined amount and such that an area of contact between the heating belt and the outer heating member is more than an area of contact between the heating belt and the inner heating member when the basis weight of the recording medium is greater than the predetermined amount.

* * * * *